US007240701B2

(12) United States Patent
Salani et al.

(10) Patent No.: US 7,240,701 B2
(45) Date of Patent: Jul. 10, 2007

(54) METHOD FOR MAKING A COLLAPSIBLE FUNNEL

(75) Inventors: Theodore R. Salani, Woodridge, IL (US); Lawrence A. Salani, Palatine, IL (US)

(73) Assignee: S&S Concepts, Inc., Elk Grove Village, IL (US)

( * ) Notice: Subject to any disclaimer, the term of this patent is extended or adjusted under 35 U.S.C. 154(b) by 89 days.

(21) Appl. No.: 10/902,633

(22) Filed: Jul. 29, 2004

(65) Prior Publication Data

US 2006/0021674 A1 Feb. 2, 2006

Related U.S. Application Data

(63) Continuation-in-part of application No. 10/480,672, filed on Aug. 3, 2004.

(60) Provisional application No. 60/327,021, filed on Oct. 4, 2001, provisional application No. 60/297,545, filed on Jun. 12, 2001.

(30) Foreign Application Priority Data

Jun. 12, 2002 (WO) ..... PCT/US02/18984

(51) Int. Cl.
*B65B 1/04* (2006.01)

(52) U.S. Cl. ..... 141/337

(58) Field of Classification Search ..... 141/331, 141/337, 338

See application file for complete search history.

(56) References Cited

U.S. PATENT DOCUMENTS 2,100,888 A * 11/1937 Vine ..... 141/337
4,108,222 A 8/1978 Kaufman
4,158,631 A * 6/1979 Whelan ..... 210/497.1
4,239,130 A 12/1980 Altadonna
4,308,986 A * 1/1982 Parrilli ..... 206/470
5,004,353 A * 4/1991 Martin ..... 366/349
5,033,521 A 7/1991 Martin
5,060,130 A 10/1991 Steigerwald
5,060,849 A 10/1991 King
5,078,189 A 1/1992 Ronsonet
5,101,870 A 4/1992 Farris (Continued)

FOREIGN PATENT DOCUMENTS

DE 674079 3/1939

(Continued)

OTHER PUBLICATIONS

About In Flight USA, In Flight USA On-Line, Feb. 19, 2003, http://www.inflightusa.com/s.info.shtml.
Disposable Funnel Ideal When Adding Oil to Vehicles And Industrial Equipment, Feb. 11, 2003, http://www.tormfgco.com/MAGAZINEWRITEUPS.html.

(Continued)

*Primary Examiner*—Steven O. Douglas
(74) *Attorney, Agent, or Firm*—Katten Muchin Rosenman LLP; John S. Paniaguas

(57) ABSTRACT

A collapsible funnel and a method for making a collapsible funnel is disclosed. In accordance with one embodiment of the invention, the collapsible funnel may be provided with a screen for filtering fluids placed into the funnel. In accordance with another aspect of the invention, a funnel is provided which includes multiple adjacent panels and a glue strip adjacent to one end, which enables the funnel to be manufactured with conventional process machines.

3 Claims, 15 Drawing Sheets

U.S. PATENT DOCUMENTS

| | | | | |
|---|---|---|---|---|
| 5,104,012 | A | 4/1992 | McAllister et al. | |
| 5,601,230 | A * | 2/1997 | Bell | 229/103 |
| 5,988,373 | A * | 11/1999 | Yates | 206/296 |
| 6,112,949 | A | 9/2000 | Rhodes et al. | |
| 6,154,891 | A * | 12/2000 | Wilson | 4/144.4 |
| 6,202,225 | B1 * | 3/2001 | Beck et al. | 4/144.2 |
| 7,028,376 | B2 * | 4/2006 | Mattesky | 24/16 PB |

FOREIGN PATENT DOCUMENTS

| | | | |
|---|---|---|---|
| DE | 8908225 | | 1/1990 |
| DE | 8908225 | U1 | 1/1990 |
| FR | 2420507 | A1 | 10/1979 |
| FR | 2497786 | A1 | 7/1982 |
| FR | 2565956 | A1 | 12/1985 |
| FR | 2621979 | A1 | 4/1989 |
| FR | 2704205 | A1 | 10/1994 |
| WO | WO 96/10533 | A1 | 4/1996 |

OTHER PUBLICATIONS

Disposable Funnel Ideal When Adding Oil to Vehicles And Industrial Equipment, Feb. 7, 2003, http://www.tormfgco.com.

Disposable Funnel Ideal When Adding Oil to Vehicles And Industrial Equipment, Feb. 7, 2003, http://www.tormfgco.com/WHERETOBUY.html.

Both Sides of Funnel Available from Basler Flight Service.

Disposable Oil Funnel (10 Pack), Feb. 5, 2003, http://shopping.pilotportal.com/catalog/product.html?productid+2572&categoryid=217.

International Search Report, Dec. 26, 2002.

Supplementary European Search Report, Apr. 7, 2006.

* cited by examiner

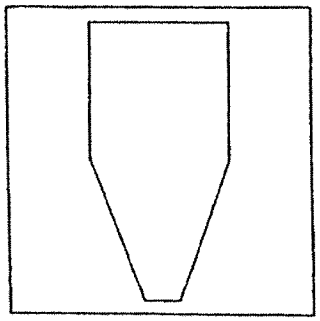
FIG. 9A
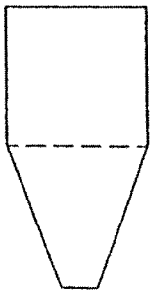
FIG. 9B
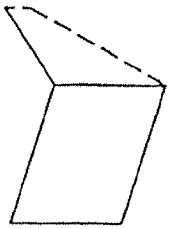
FIG. 9C
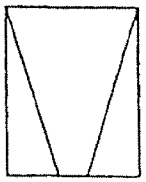
FIG. 9D
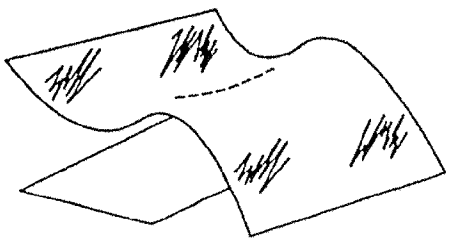
FIG. 9E
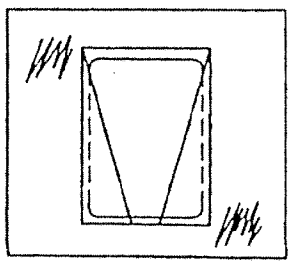
FIG. 9F
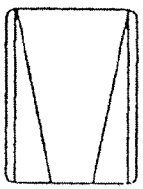
FIG. 9G
FIG. 9H FIG. 20B
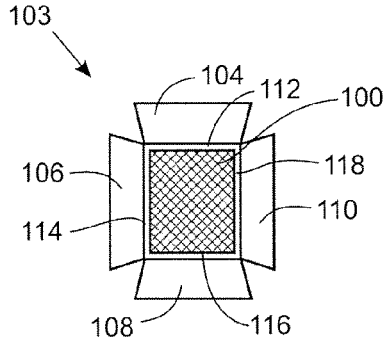
FIG. 20C
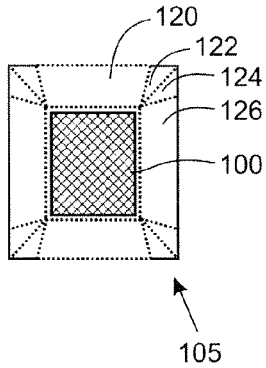
FIG. 20A
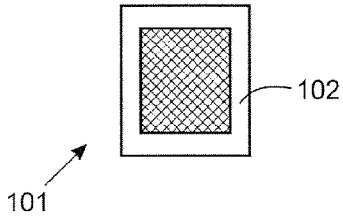
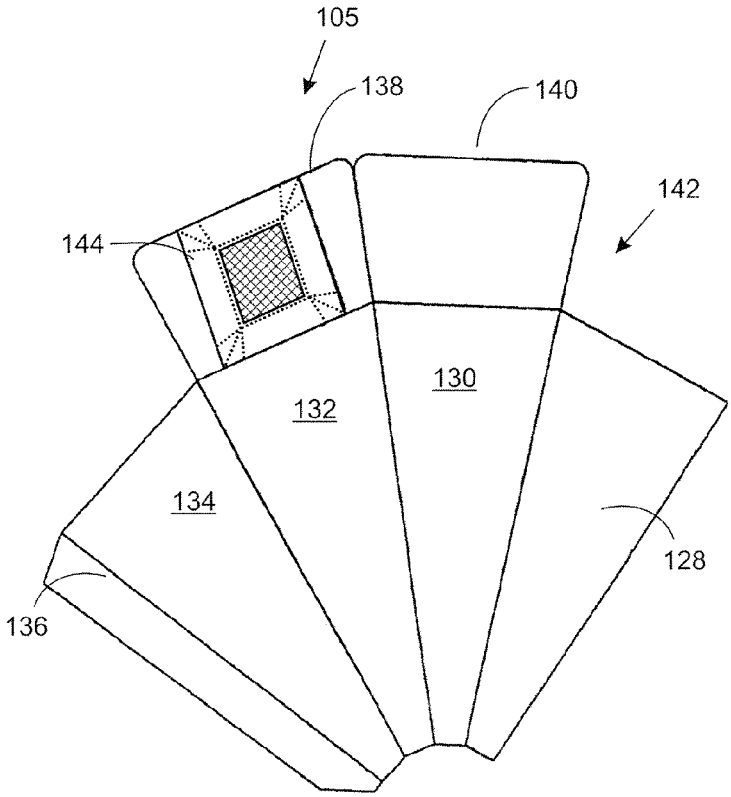
FIG. 21

FIG. 22A
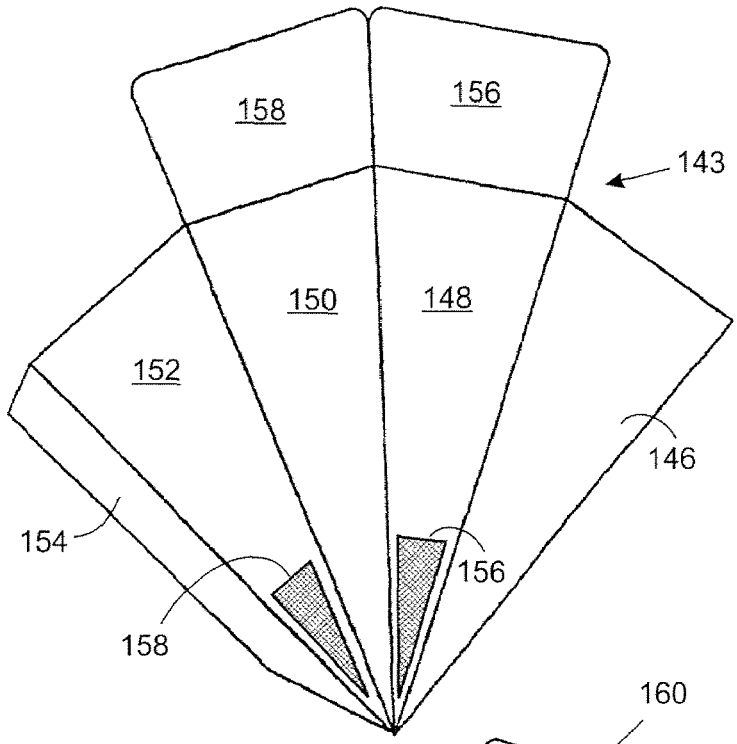
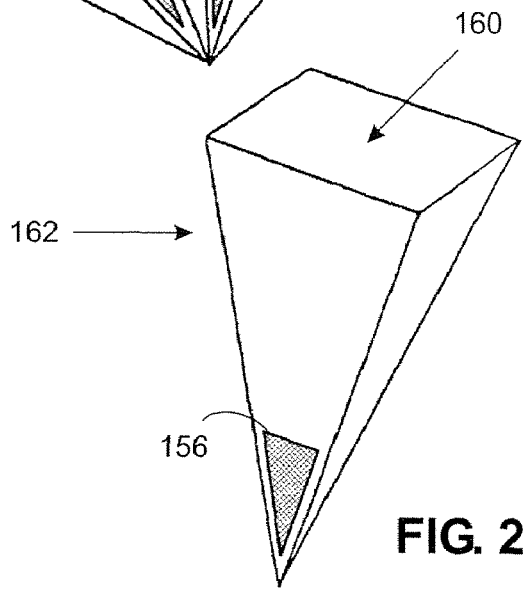
FIG. 22B

METHOD FOR MAKING A COLLAPSIBLE FUNNEL

CROSS-REFERENCE TO RELATED APPLICATIONS

This application is a continuation-in-part of commonly owned U.S. patent application Ser. No. 10/480,672 filed on Dec. 12, 2003, which, in turn, is the national stage of international Patent application No. PCT/US02/18984, filed Jun. 12, 2002, which, in turn, claims priority and the benefit of U.S. Provisional Patent Application Ser. No. 60/297,545, filed on Jun. 12, 2001 and U.S. Provisional Application No. 60/327,021, filed on Oct. 4, 2001.

BACKGROUND OF THE INVENTION

1. Field of the Invention

The present invention relates to a collapsible funnel and a method for making a funnel and more particularly to a funnel packaged in a collapsed form and adapted to be quickly and easily expanded into a funnel, the funnel being formed from a piece of flat stock with a plurality of adjacent panels and a glue strip adjacent one end which enables the panels to be attached together and folded several times so that the collapsed configuration of the funnel is the size of a single panel, one embodiment of the funnel including a screen for filtering fluids placed in the funnel.

2. Description of the Prior Art

Various funnel systems are known for use with various fluids. A common application of such funnel systems relates to the use of various fluids in various vehicles including automobiles. For example, motor oil is normally provided in a sealed can or a container with a screw off cap. Such motor oil is sold in most retail distribution markets as well as in various service stations. In order to avoid spilling the oil all over the engine, normally a re-usable funnel is used and inserted into the oil receiving receptacle of the engine. In many applications, such funnels are not readily available and as such consumers who purchase oil in service stations take the chance of spilling oil on various engine parts while attempting to pour the engine oil into the engine oil receiving receptacle on their automobile engine.

In order to resolve this problem, various systems have been developed, for example, as disclosed in U.S. Pat. Nos. 5,101,870; 5,104,012; 5,033,521; 4,239,130; 6,112,949; 5,060,849; 5,601,230 and French Patent No. 2 565 956. In particular, U.S. Pat. No. 5,104,012 discloses a container with a flexible tube removably attached to the exterior of the container in a flattened position that is adapted to be attached to a spout on a container to form a dispenser for dispensing the fluid within the container. U.S. Pat. No. 6,112,949 discloses a container with an extendable bellows-like tube disposed within the container that is adapted to be pulled out when the cap is removed to form a dispenser for the fluid within the container. U.S. Pat. No. 5,033,521 discloses an oil cap for sealing the inlet port of an oil receiving receptacle on an automobile. The cap is configured with a collapsible funnel. U.S. Pat. No. 5,101,870 discloses a fluid container with a disposable funnel formed to the contour of an upper portion of the container and adapted to fit over the top outside of the container and be secured thereto by way of the cap. With such a configuration, when the cap is removed, the disposable funnel is inverted and inserted into the oil receiving receptacle to enable the fluid within the container to be poured into the oil receiving receptacle without making a mess. U.S. Pat. No. 4,239,130 discloses an oil caddy adapted to be secured in a trunk of an automobile or other vehicle which includes a canister for holding an oil can and a funnel attached to the upper portion of the canister. The funnel in this embodiment is not disposable. French Patent No. 2 565 956 discloses a collapsible funnel system formed from a number of concentric rings which are configured such that in an expanded configuration, the concentric rings form a funnel. The patents disclosed above all disclose various types of funnels for use with various fluids. Unfortunately, all of these systems are rather complicated and thus expensive which explains why none of these systems are in widespread use.

Other funnel-type systems are known which are less expensive to produce. For example, U.S. Pat. No. 5,060,849 discloses a carton for carrying, for example, a case of oil containers. The carton is provided with various die cuts which enable the carton to be folded in two different configurations thus providing a dual purpose carton. In one configuration, the carton may be folded into a box for simply carrying various fluid containers. In the alternate configuration, the carton can be refolded into a funnel to facilitate pouring of the fluid content within one of the containers. U.S. Pat. No. 5,601,230 discloses another less expensive type funnel system. In particular, the '230 patent discloses a box for carrying multiple fluid containers. The lid of the box is die cut and preformed with fold lines which are prestamped to enable a portion of the lid to be removed from the top of the box and folded into a funnel. The problem with the systems disclosed in the '849 and '230 is that these patents disclose a funnel system in which a single disposable funnel is provided for a multiple number of fluid containers. Unfortunately, with such a design it is very likely that once the funnel is formed and used once it will likely be discarded and not available for use for the remaining fluid containers. Thus, there is a need for a collapsible funnel for use with a fluid container which will likely be available for use with each individual fluid container.

SUMMARY OF THE INVENTION

The present invention relates to a collapsible funnel and a method for making a collapsible funnel. In accordance with one embodiment of the invention, the collapsible funnel may be provided with a screen for filtering fluids placed into the funnel. In accordance with another aspect of the invention, a funnel is provided which includes multiple adjacent panels and a glue strip adjacent one end, which enables the funnel to be manufactured with conventional process machines.

DESCRIPTION OF THE DRAWINGS

These and other advantages of the present invention will be readily understood with reference to the following specification and attached drawing wherein:

FIGS. 9A–9H are process diagrams that illustrate the step-by-step process for forming another alternate embodiment of the invention.

FIGS. 14A, 15A and 16A are alternate embodiments of funnels in accordance with the present invention shown in collapsed form while

FIGS. 20A–20C are plan views of three exemplary configurations of a screen formed as a separate member for use with the various collapsible funnels illustrated herein.

FIG. 21 is an alternate embodiment of the collapsible funnel with a screen in which the screen is formed in a header card attached to one of the panels.

FIGS. 22A and 22B illustrate another alternate embodiment of a collapsible funnel with one or more screens incorporated near the bottom of the funnel defining one or more fluid discharge ports of the funnel.

DETAILED DESCRIPTION

Figure 11A:
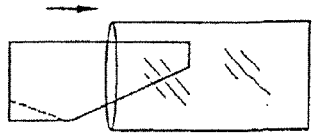
FIGS. 11A and 11B illustrate a package for the collapsible funnel in accordance with the present invention.
Figure 11B:
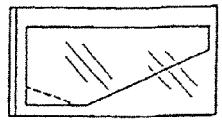
Figure 12A:
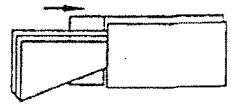
FIGS. 12A and 12B illustrate an alternate package for the funnels in accordance with the present invention.
Figure 12B:
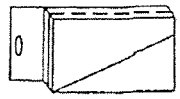
Figure 13A:
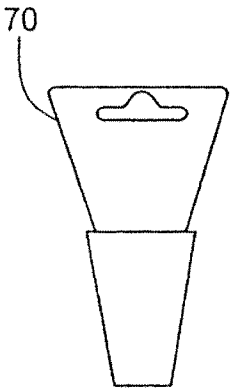
FIGS. 13A–13G illustrate alternate header cards for use with the present invention.
Figure 13B:
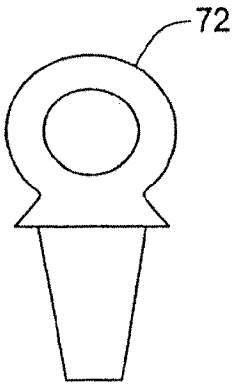
Figure 13C:
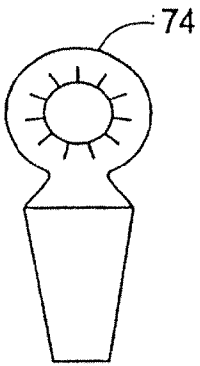
Figure 13D:
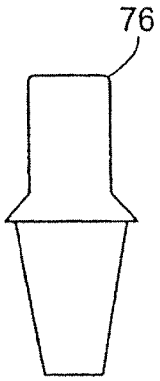
Figure 13E:
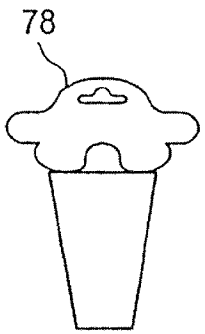
Figure 13F:
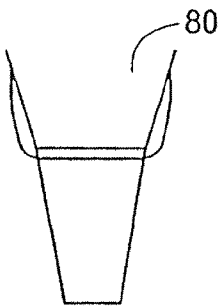
Figure 13G:
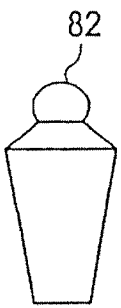
Figure 14A:
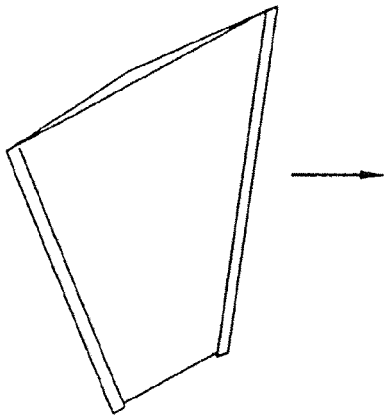
Figure 14B:
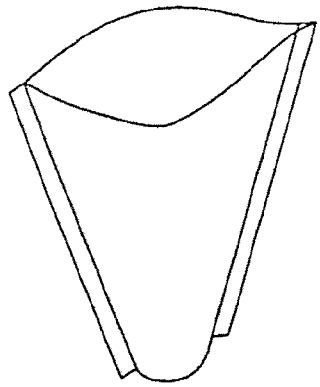
FIGS. 14B, 15B and 16B illustrate these funnels in expanded form.
Figure 15A:
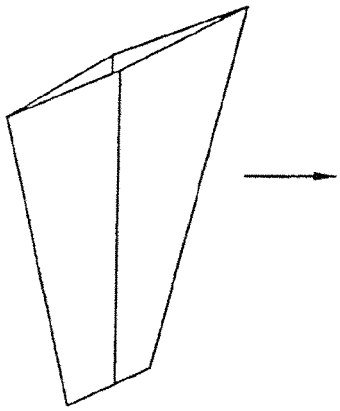
Figure 15B:
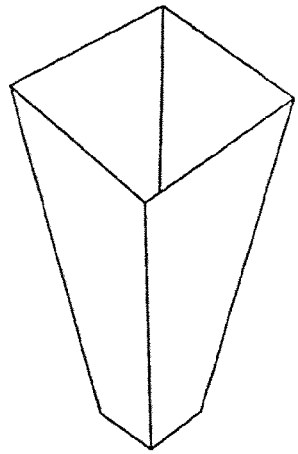
Figure 16A:
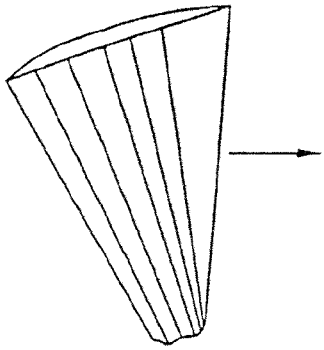
Figure 16B:
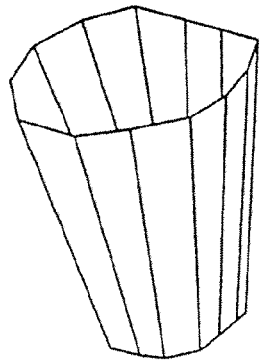

Various embodiments of the invention are contemplated. For example FIGS. 1–6, and 14–16 relate to a collapsible funnel in accordance with the present invention while FIGS. 7–10, 17 and 18 illustrate a process for making disposable funnels having different configurations. FIGS. 11–12 illustrate various package configurations for packaging a disposable funnel in accordance with the present invention. FIGS. 14–16 illustrate various embodiments of a funnel with different configurations of a header card in accordance with the present invention. FIG. 19 illustrates a funnel blank with optional perforation lines and/or printed indicia which allows the diameter of the funnel nozzle to be selected by the user. FIGS. 20A–20C; 21; 22A and 22B illustrate an alternate embodiment of the invention which relates to a collapsible funnel with a screen for filtering fluid placed in the funnel. FIGS. 23A–23F and 24A–24I illustrate an alternate method of manufacturing the funnel utilizing standard process machines.

Collapsible Funnel

Figure 1:
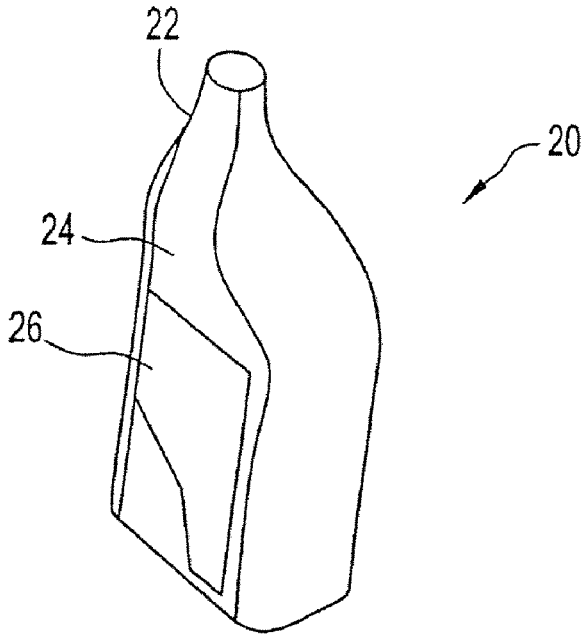
FIG. 1 is perspective view of a collapsible funnel in accordance with the present invention removably attached to a container in accordance with the present invention.
Figure 5:
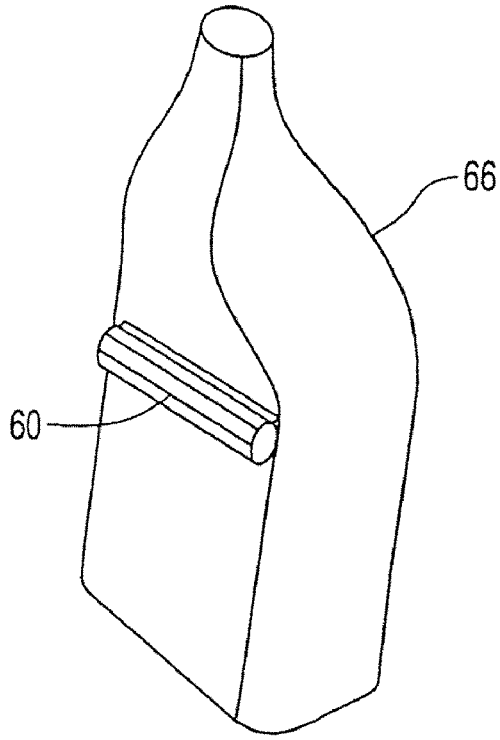
FIG. 5 is a perspective view of another alternate embodiment of the invention in which the funnel is shown in a rolled configuration and attached to a container.

The present invention in one embodiment relates to a collapsible funnel that in one embodiment is adapted to be releasably secured to a container or a label. The collapsible funnel in accordance with the present invention is relatively simple and inexpensive and enables the funnel to be provided with each individual container as illustrated in FIGS. 1 and 5; packaged separately, for example, in a multi-pack as illustrated in FIGS. 11A, 11B, 12A, 12B, 18E and 18F; or attached to a label as illustrated in FIG. 3.

The funnel may be disposable. In one embodiment of the invention, as illustrated in FIGS. 1 and 2A–2C, the funnel may be formed from a paper stock, such as 80 pound cover glass or coated stock, plastic, etc. and optionally formed with preformed folds to enable the funnel to be folded in quarters and attached to a container with a suitable adhesive, such as rubber cement or an adhesive commonly known as glue dots.

Figure 3:
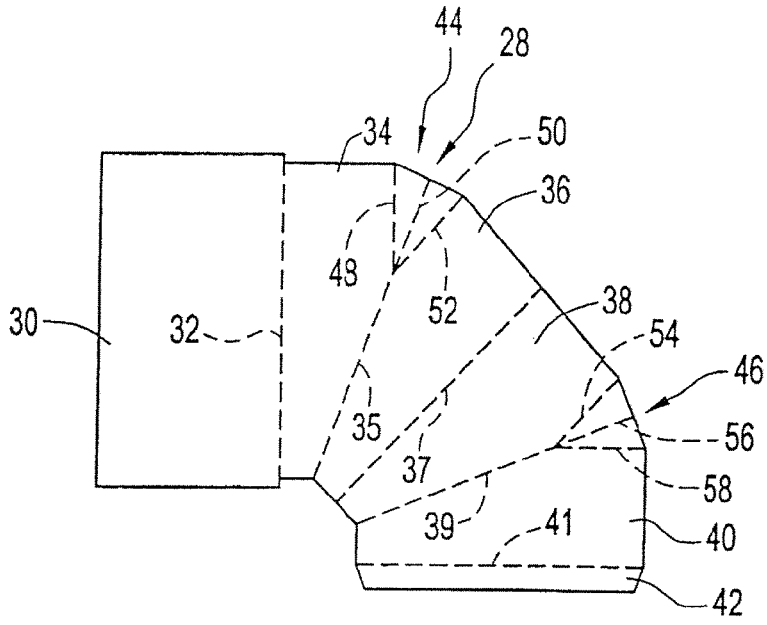
FIG. 3 is a view of yet another alternate embodiment of a collapsible funnel that is configured to be attached and formed as part of the label on a container.
Figure 4A:
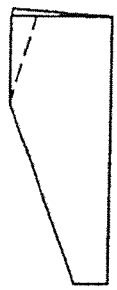
FIGS. 4A–4C illustrate a fully collapsed, intermediate and fully expanded configuration of the disposable funnel illustrated in FIG. 3.
Figure 4B:
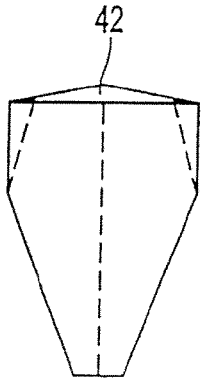
Figure 4C:
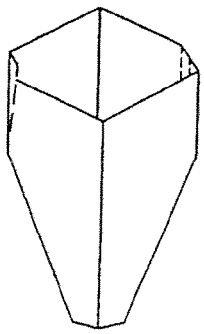
Figure 6A:
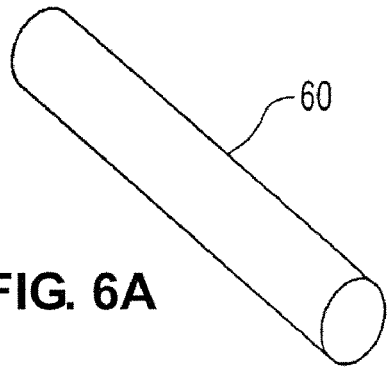
FIG. 6A is a perspective view of a disposable funnel shown in a rolled configuration.
Figure 6B:
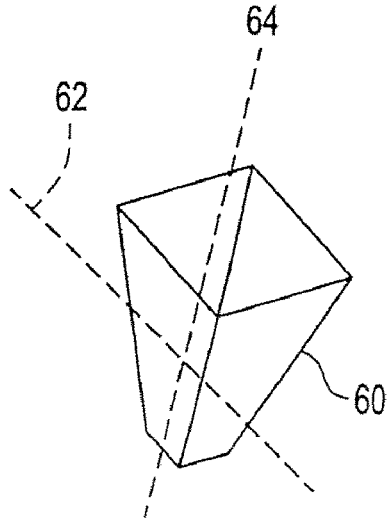
FIG. 6B is a perspective view of the funnel illustrated in FIG. 6A in a fully expanded configuration.

In an alternate embodiment as illustrated in FIG. 3, the disposable funnel is configured to be removably attached to a label. FIGS. 4A–4C illustrate an embodiment of the funnel which may be attached to a label by way of a perforation or alternatively attached to a container as shown in FIG. 1. FIGS. 5, 6A and 6B illustrate yet another embodiment of a disposable funnel which may be releasably attached to a container. In this embodiment, the disposable funnel may be folded or rolled along either its longitudinal or transverse axis into a tubular shape and releasably attached to the exterior of the container. All of the embodiments disclose a disposable funnel for use which may be integrated with a container in order to provide an individual disposable funnel for use with each container.

Various configurations of the collapsible funnel in accordance with the present invention are contemplated as shown in FIGS. 1, 7–20, 13–16 and 17–19. Turning to FIG. 1, a perspective view of a container with an integrated funnel is illustrated and generally identified with the reference numeral 20. The container 20 may be used for any fluid and may be formed from any material normally used for containers, such as plastic, glass or metal. As shown, the container 20 may be formed with a spout or dispensing port 22 and at least one flattened surface 24 for receiving a funnel 26 in a folded or compressed form. Alternatively, the container 20 may be formed without a flattened surface 24. In such an application, the funnel 26 may be attached to an arcuate surface in the same manner as a label is attached to arcuate surfaces of various containers. In either embodiment, the funnel 26 is in a flattened and compressed form and releasably attached to the container 20 to provide an individual disposable funnel 20 for each container 22. As such, the invention is well suited in applications for use with motor oil, transmission fluid and the like, normally sold in service stations, where such items are normally sold individually. In accordance with the present invention, each container is provided with a detachable disposable funnel to facilitate pouring of the fluid within the container.

Figure 2C:
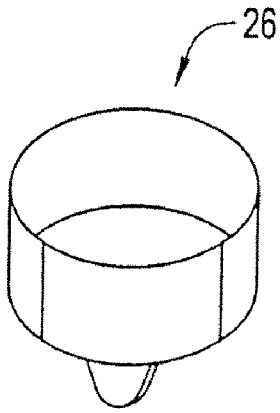
FIGS. 2A–2C illustrate the various stages of the funnel from a fully collapsed position as shown in FIG. 2A to a fully open position as shown in FIG. 2C.
Figure 2B:
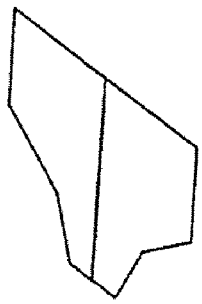
Figure 2A:
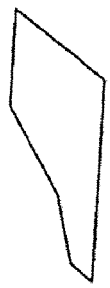

An exemplary funnel configuration is illustrated in FIGS. 2A–2C. As shown in FIG. 2A, the funnel 26 is shown in a fully collapsed form and folded in quarters. FIG. 2B illustrates an intermediate configuration of the funnel 26, shown folded in half. FIG. 2C illustrates a fully expanded funnel 26 for use with the fluid within the container 20.

FIG. 3 illustrates an alternate embodiment of the funnel 28 which may be releasably attached to a label 30, which, in turn, is secured to a container 32 or inserted into a printed publication. As shown in FIG. 3, the funnel 28 is formed from a piece of flat stock and releasably attached to a label 30, for example, by way of a perforation 32, formed, for example, by way of a die cut. In this embodiment, the funnel 28 is formed from a piece of flat stock in the shape, for example, as shown in FIG. 3 four panels 34, 36, 38 and 40 defined by four fold lines 35, 37, 39 and 41 and a glue tab 42. The funnel 28 may also be optionally formed with opposing tabs 44 and 46, formed from a plurality of fold lines 48, 50, 52, 54, 56 and 58. These tabs 44 and 46 may optionally be provided to prevent collapse of the funnel 28 after it is expanded to its final use configuration.

FIGS. 4A–4C illustrate the assembly of the flat stock forming the funnel 28 in accordance with this aspect of the invention. Initially, the flat stock 28 may be folded along the fold line 37 while at the same time securing the glue flap 42 to the panel 34 adjacent the perforation line 32. The funnel 28 may also be optionally folded along the fold lines 35 and 39 to form the flat quartered configuration illustrated in FIG. 4A. The funnel 28 can then be expanded as illustrated in FIG. 4B by separating the panels. Once the panels are separated, the tabs 44 and 46 may be squeezed together to minimize the possibility of collapse of the funnel 28 during use.

The flat stock mentioned above may also be used in an application when it is not attached to a label as illustrated in FIGS. 1 and 2A–2C. In this application, the flattened funnel 28 is preassembled into the flattened configuration as illustrated, for example, in FIG. 4A. The flattened funnel 28 is attached to the container 22 with a suitable adhesive. In this embodiment, the funnel 28 may be provided with or without the tabs 44 and 46.

Another of embodiment of the invention is illustrated in FIGS. 5, 6A and 6B. In this embodiment of the invention, a funnel 60 may be rolled or folded relative to a transverse axis 62 or a longitudinal axis 64 to form a generally tubular configuration as illustrated in FIGS. 6A. This tubular configured funnel 60 may be attached to a container 66. The container 66 may be formed with an exterior cavity (not shown) either along the sides or underneath which conforms to the general shape of the tubular configuration of the funnel 60.

Process for Making a Collapsible Funnel

The collapsible funnel in accordance with the present invention can be made by various processes. An exemplary process for making the collapsible funnel is described below and illustrated in FIGS. 7–10 for four exemplary embodiments of the collapsible funnel in accordance with the present invention. It should be understood that the process described below may also be used to fabricate the collapsible funnels illustrated in FIGS. 1, 3, 6 and 14–16 as well as the collapsible funnels formed with header cards as illustrated in FIGS. 13, 17 and 18. Any one of these steps may or may not be used in this process and may be used in any order.

Step 1. Printing of Folding Funnel (Optional)

The paper stock to be used for the funnel blank may be printed in any desired configuration, using any traditional or nontraditional method. This step may include standard offset printing on a Komori or any similar machine. Perfecta machines, thermal transfer machines, silkscreen machines, digital or plateless machines or even stamping or embossing machines which embed an image on the material without using inks or any other machine and/or process which can achieve the same or similar result desired. In other words, any method of transferring a visible impression onto the material may be used. The printing can essentially be done at various steps in the process.

Step 2: Cutting

The stock, for-example, paper stock, is die cut, for example, into a specific pattern as illustrated in FIGS. 7A, 8A, 9A and 10A, for example, forming a funnel blank. The die cutting may be done by a Zerand Web Cutter, for example.

Step 3. Scoring and Cutting

The funnel blank may optionally be scored, for example, a Zerand Web Cutter Creaser or any other machine and/or process which can achieve the same or similar desired results, for example, as illustrated in FIGS. 7B, 8B, 9B and 10B. The scoring is used to define fold lines which facilitate the assembly of a funnel blank into a funnel. In same embodiments, for example, as shown in FIGS. 14A and 14B, scoring may not be required.

Step 4. Folding and Gluing

The optionally scored and cut material can then be folded and, if desired, glued on a Bobst Flexo-Folder Gluer or any other machine and/or process which can achieve the same or similar result desired. The material does not have to be glued. Various adhesives are suitable, such as double-sided tape, glue strip, small tabs or any type of channel that can be used to manually hold together the ends of the cut material (FIGS. 7C–7E, 8C–8D, 9C–9E and 10C–10E.)

Secondary Process Steps

The collapsible funnel in accordance with the present invention can be used in various applications. Depending on the application, various secondary processing steps are required.

Option #1. Inserting the Folded Funnel

The folded funnel can be inserted into various secondary containers or dispensers using a Sitma C80/305 Polywrapper, Autobagger H-100 or Sencorp Automatic Heat Sealing Machine such as a Model HP 15-6E, and/or process that can achieve the same or similar result desired. This secondary container or dispenser can be of any type, from a small pouch holding one or more folded funnels to a large dispensing unit holding many folding funnels. Exemplary secondary containers are illustrated in FIGS. 11A, 11B, 12A and 12B.

Option #2. Applying the Folded Funnel

Figure 7A:
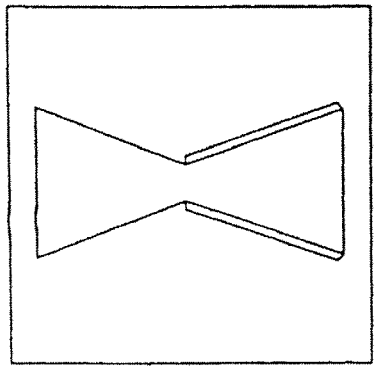
FIGS. 7A–7I are process diagrams that illustrate the step-by-step process for forming one embodiment of the invention.
Figure 7B:
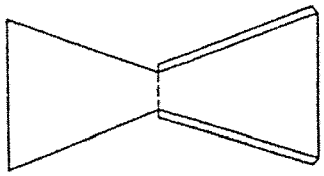
Figure 7C:
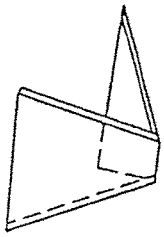
Figure 7D:
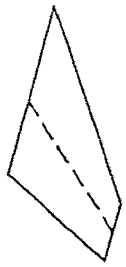
Figure 7E:
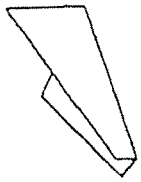
Figure 7F:
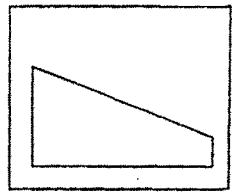
Figure 7G:
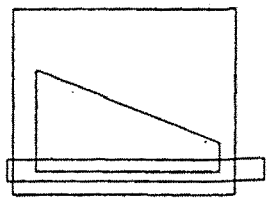
Figure 7H:
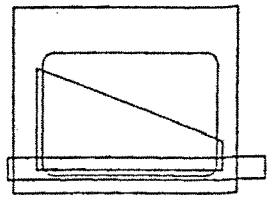
Figure 7I:
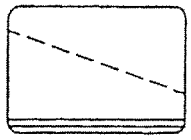
Figure 8A:
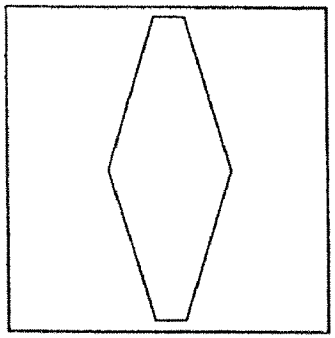
FIGS. 8A–8H are process diagrams that illustrate the step-by-step process for forming an alternate embodiment of the invention.
Figure 8B:
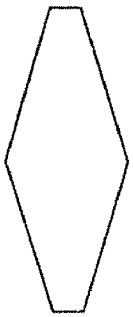
Figure 8C:
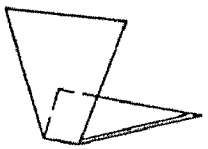
Figure 8D:
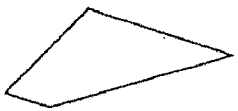
Figure 8E:
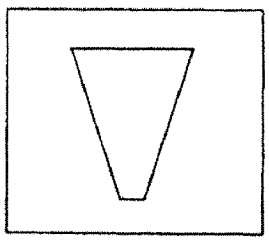
Figure 8F:
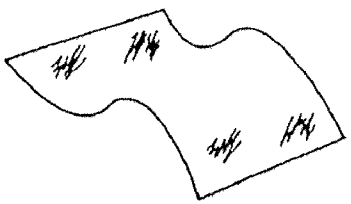
Figure 8G:
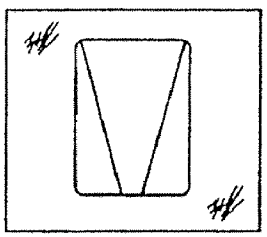
Figure 8H:
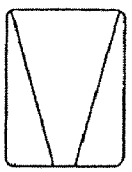
Figure 10A:
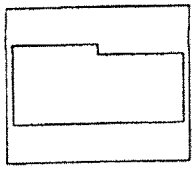
FIGS. 10A–10H are process diagrams that illustrate the step-by-step process for forming another embodiment of the invention.
Figure 10B:
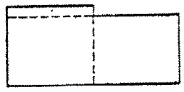
Figure 10C:
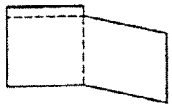
Figure 10D:
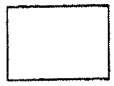
Figure 10E:
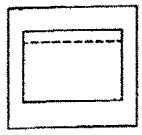
Figure 10F:
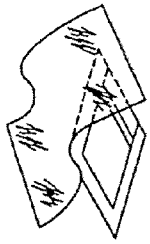
Figure 10G:
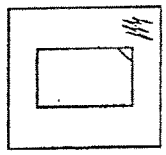
Figure 10H:
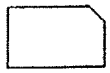

The funnel may be affixed to a cardboard, paper or pressure-sensitive-backing using a hot melt releasable adhesive. This is typical when using "stacker", "Pick 'n-Place" or any similar type of placing process. Furthermore the funnel may be placed over the cardboard, paper, or pressure-sensitive backing and then covered with adhesive film (or any similar material) or laminated in place on said backing (FIG. 7G, for example.) The funnel unit/label can then be die cut and perforated if desired on a Soft-Anvil Rotary Die Cutting System or any other machine and/or process which can achieve the same or similar result desired (FIG. 7I, for example.) This process is typical in the production of roll-fed labels. (FIGS. 7F–7I and 8E–8H)

Option #3. Applying the Scored/Folded Material or Folded Funnel to Pressure Sensitive Adhesive The funnel may be placed, affixed or overlapped on a pressure sensitive adhesive or any similar material. An adhesive film (any similar material) or laminate can then be applied over the combination of materials creating a one piece/unit (FIGS. 7F and 7G). The funnel unit/label can then be die cut and perforated if desired on a Soft-Anvil Rotary Die Cutting System or any other machine and/or process which can achieve the same or similar result desired (FIG. 7H). This process is typical in the production of roll-fed labels (FIGS. 7F–7H).

Collapsible Funnel With Header Cards

Header cards, for example, as generally identified with the reference numerals 70–82 (FIG. 13), can be integrally formed with the funnel. Various configurations of the header cards 70–82 are contemplated. For example, the header card 70 (FIG. 13A) may be used for hanging hook, peg board and any standard point of sale merchandise unit. The header card 72 (FIG. 13B) may be used in applications where the funnel is to be attached to a container top. The header card 74 (FIG. 13C) is similar to the header card 72 but allows for a tighter fit. The header card 76 (FIG. 13D) is formed as an elongated tab which allows it to be inserted into a slot. The header card 78 (FIG. 13E) may be custom configured and may be die cut to personalize corporate logos, events symbols or anything desired. The header 80 (FIG. 13F) consists of an attached string, where x or plastic tie for attachment. The header 82 (FIG. 13G) includes a combination of a header card and an attachment material, for example, an elastic material made from flexible rubber, plastic or other material which returns to it s original size after being stretched out.

Figure 17A:
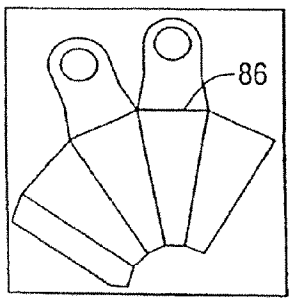
FIGS. 17A–17D illustrate a disposable blank shown with a one embodiment of a header card in accordance with the present invention.
Figure 17B:
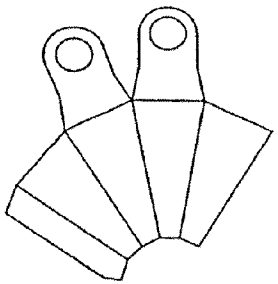
Figure 17C:
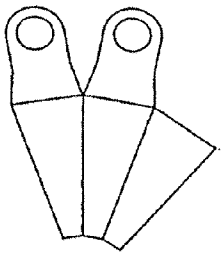
Figure 17D:
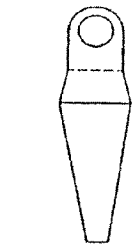
Figure 18A:
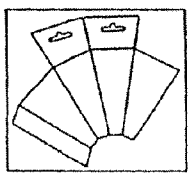
FIGS. 18A–18F illustrate an alternate embodiment of a funnel blank with an alternate header card.
Figure 18B:
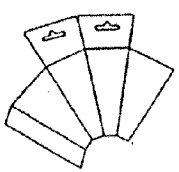
Figure 18C:
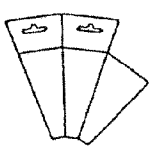
Figure 18D:
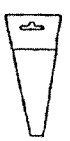
Figure 18E:
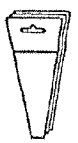
Figure 18F:
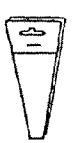
Figure 19:
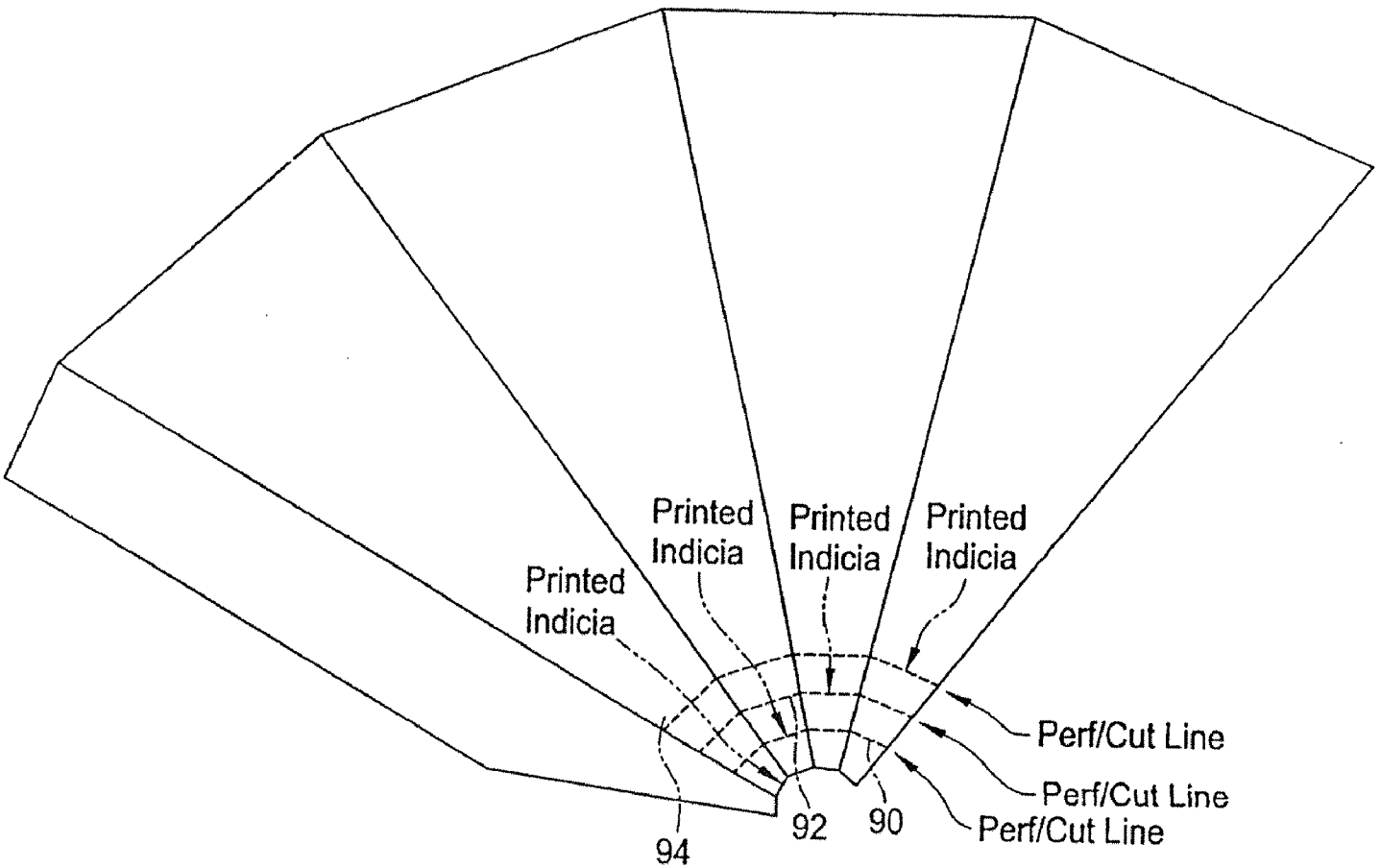
FIG. 19 illustrates an exemplary funnel with perforation marks and printed indicia related to the perforation marks which enables the diameter of the funnel hole to be selected by the end user.

The process for making collapsible funnels with header cards is similar to the process described above with the exception that the funnel blank is die cut with the funnel and integral header card, for example, as illustrated in FIGS. 17A and 18B. As shown in FIGS. 17B–17D and 18B–18D, the collapsible funnels are fabricated using virtually the same steps. However, various options are available for the interface 86 (FIG. 17A) defined between the collapsible funnel and header card. For example, the interface may be a perforation, a fold line or neither. As shown in FIGS. 18E and 18F, the collapsed device can be combined with multiple similar devices in various configurations, such as stacking and attached together by various methods. For example, the funnels can be attached together by stapling, stitching, glue, heat attachment, tape, insertion into another container, for example, as illustrated in FIGS. 11 and 12, or alternately by riveting or posts. In addition, a single header card can be made to hold multiple devices.

Collapsible Funnel With Selectable Spout Size

FIG. 19 illustrates an aspect of the invention in which the funnel fluid outlet opening size is selectable. In this embodiment, perforations 90, 92 and 94 may be formed adjacent an outlet end of the funnel blank. The location of the perforations 90, 92 and 94 are selected to allow the fluid outlet opening size of the funnel to be selected. Originally, the funnel blank may optionally be formed with a fluid inlet opening and a first fluid outlet opening. Tearing along the perforations 90, 92 and 94 will result in relatively larger fluid outlet openings. Indicia may optionally be printed adjacent each of the perforation lines 90, 92, and 94 to indicate the size or use (i.e. motor oil, transmission fluid) of each fluid outlet opening size. In lieu of perforating, the perforation lines may simply be printed on the funnel blank. By providing selectable fluid outlet sizes, one funnel configuration can be used in multiple applications.

Business Method The flat funnel blanks as illustrated in FIGS. 2, 3, 7–10 and 17–19 may be used in other applications prior to assembly. For example, the funnel blanks may be used as a substrate for printed indicia and used as a printed publication or incorporated into a printed publication, such as a sports program, catalog or advertisement. For example, a funnel blank may be used at a NASCAR race as a racing program. In this embodiment, the funnel blank can be used either still attached to the sheet of stock shown in FIGS. 7A, 8A, 9A and 10A or detached from the paper stock as shown in FIGS. 7B, 8B, 9B and 10B.

Collapsible Funnel With Screen

Three embodiments of a funnel with a screen are illustrated in FIGS. 20A–20C, 21, and 22A–22B. The embodiments illustrated in FIGS. 20A–20C illustrate a first embodiment of a screen in which the screen is formed separately from the funnel. In this embodiment, the screen, generally identified with the reference numeral 100, may be formed with a generally square cross-section for use with collapsible funnels with a generally square cross-section when the funnel is expanded, for example, as the funnels illustrated in FIGS. 23A–23F and FIGS. 24A–24I. Other configurations of the screen are also contemplated to enable the screen to be used with funnels having virtually ant cross section.

The screen 100 can be made from various materials including nylon, paper, metal or plastic. The screen 100 can be matted and configured in various ways in order to fit within a funnel. In particular as shown in FIG. 20A, the screen 100 can be matted with a generally square matting 102 as generally shown in FIG. 20A. Alternately, the matting can be formed with a plurality of flaps 104, 106, 108 and 110 which are scored along fold lines 112, 114, 116 and 118 to enable the flaps 104, 106, 108, 110 to be easily folded and inserted into a funnel, as generally shown in FIG. 20B.

FIG. 20C illustrates an alternate embodiment of the invention in which a single matting 120 is formed around the screen. In this embodiment, each corner is provided with three fold lines 122, 124, 126 to enable the matting at 120 to be folded and inserted into a funnel in a manner similar to the embodiment illustrated in FIG. 20B with the four flaps 104, 106, 108 and 110.

As mentioned above, the various embodiments of the screens illustrated in FIGS. 20A–20C and generally identified with the reference numerals 101, 103 and 105, respectively, are formed separately from the funnel. With such embodiments the screens, 101, 103, 105 are attached to the funnel by various means including staples, glue or other adhesives.

Alternative to the embodiments illustrated in FIGS. 20A–20C, the screen can be integrally formed with the funnel, as generally shown in FIG. 21. More particularly, referring to FIG. 21, the funnel is formed from a piece of flat stock 142, formed with a plurality of contiguous irregularly shaped panels 128, 130, 132, 134 defined by fold lines and an optional glue strip 136. In this embodiment, one or more header cards 138 and 140 are formed on top of the panels 132 and 130, respectively. As illustrated in FIG. 21, the screen 105, for example, is integrally formed with the header card 138. The header cards 138, 140 are removably attached from the panels 132 and 130, respectively, by way of perforations, generally identified with the reference numeral 144. Thus, after the user tears off the header card 138, the screen 105 is separated from the remaining portion of the header card 138 and inserted into the funnel after it has been expanded.

FIGS. 22A and 22B illustrate yet another embodiment of a funnel with an integrally formed screen. In this embodiment, the screen in integrally formed in one or more of the panels making up the funnel and thus functions as a fluid exit port. More particularly with reference to FIG. 22, a funnel blank 143 is formed with four panels 146, 148, 150, 152 defined by a plurality of fold lines and an optional glue strip 154. The funnel blank 143 is configured to be formed into a funnel having a collapsed configuration and an expanded configuration which defines a fluid inlet end and a fluid outlet end. In this embodiment, unlike the embodiment illustrated in FIG. 21, one or more screens 156 and 158 are formed in the panels 146, 148, 150, 152 and function as the only fluid exit openings ports in the funnel.

Header cards may optionally be formed on top of the panels 148 and 150. One or more header cards 156 and 158 may be optionally attached to the panels 148 and 150, respectively, for example, by perforations or otherwise to enable the header cards 156,158 to be easily removed Numerous methods are contemplated for forming the screens 156 and 158 in the side panels 148 and 150, respectively. In particular, each of the panels 146, 148, 150 and 152 may be formed in a generally triangular shape. An aperture, for example, a triangular shape aperture may be formed adjacent the apexes of one or more of the panels 146, 148, 150 and 152 as generally shown in FIGS. 22A and 22B. One or more screens 156 and 158 are provided with matting which is attached to the panels 146, 148, 150, 152 and juxtaposed so that the screens 156, 158 totally cover up the openings therein. Alternatively, an oversized piece of screen may simply be glued to the panels such that the screen totally closes the apertures. The screens 156, 158 may be stapled or affixed to the panels 146, 148, 150 and 152 by various methods including use of various adhesives.

FIG. 22B illustrates a fully assembled funnel 162 with an integrally formed screen 156, shown formed in one of the panels 146, 148, 150, 152. In this embodiment, the optional header cards 156 and 158, if provided, are shown removed. Fluid is poured into the fluid inlet opening, generally identified with the reference numeral 160, and exits the funnel 162 via the screen 156.

Improved Manufacturing Process

Figures 23A, 23B, 23C, 23D, 23E, 23F:
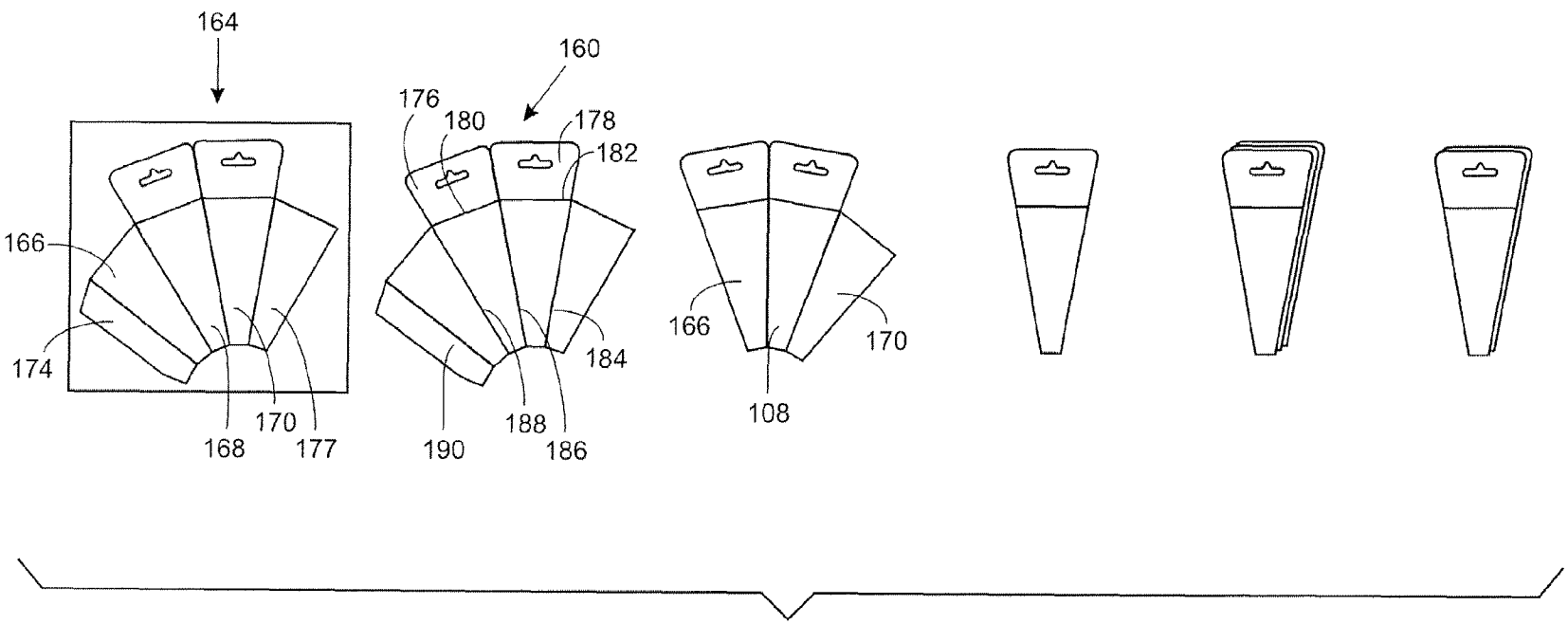
FIGS. 23A–23F illustrate the exemplary configurations of the collapsible funnel during the manufacturing process from flat stock to a sn exemplary shipping configuration.

FIGS. 23A–23F and 24A–24I illustrate a configuration for a funnel and a manufacturing process which enables standard folder gluer machines to be used for fabricating the funnel and configuring it in a collapsed form in accordance with the present invention. Initially, as shown in FIG. 23A, a funnel blank 160, formed from flat stock 164 is provided. The funnel 160 is formed with a plurality of irregularly shaped contiguous panels, 168, 170, 172 and 172 defined by a plurality of fold lines 184, 186 188 and 190 as illustrated in FIG. 23B. A glue strip 174 is formed adjacent an end panel 166. The funnel 160 may be provided with optional header cards 177 and 178. The header cards 177 and 178 may be removably attached to the panels 168 and 170 by way of perforations 180 and 182.

The above configuration enables the funnel blank 160 to be formed into a collapsible funnel as shown in FIG. 23D by way of conventional folder gluer machines. Indeed, various folder gluer machines can be utilized. It is only important that the folder gluer machines have a feeding system that is able to feed irregular shapes and be able to fold the irregular shapes right and left and keep them straight through the folding and gluing process. Folder gluer machines by the following companies are capable of performing the process steps disclosed below: Brausse Group/PEPrintech Equipment; Bobst; American International Machinery; Omega Folder Gluer currently distributed by Can-Am Packaging Equipment Corp; Jagenberg Inc. or Jagenberg Daina GmbH; AIDIA folder gluer distributed currently by Kepes Inc; Lunex Maschinebau GmbH; Vesta folder gluer currently distributed by Matik North America; Anter folder gluer currently distributed by Presswerx; Robert Polypro Inc.; Standard Paper Box Machine Co. Inc; and Universal Folder Gluer.

Figures 24A, 24B, 24C, 24D, 24E, 24F, 24G, 24H, 24I:
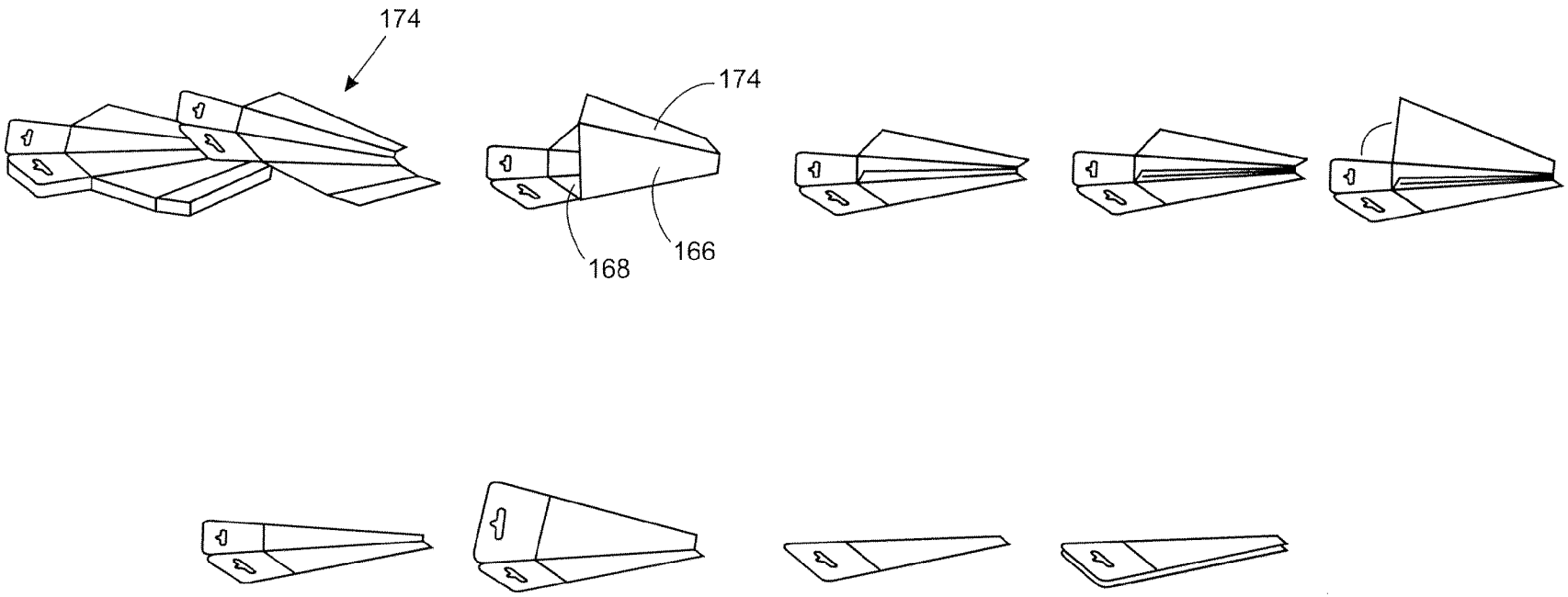
FIGS. 24A–24I illustrate a manufacturing process for a collapsible funnel in accordance with another aspect of the invention.

Turning to FIGS. 23A–23F and FIGS. 24A–24I, initially as shown in FIG. 24A, an irregularly shaped flat funnel blank 160 is fed into a conventional folder gluer machine (not shown). As shown in FIG. 24B, in a first step the panel 166 is folded over the panel 168 to form the configuration as shown in FIG. 23C. Next, glue is applied along the exposed glue strip 174, as generally shown in FIGS. 24A and 24B. After the glue has been applied along the glue strip 174, as generally shown in FIGS. 24C and 24D, the machine folds panel 172 onto the glue strip 174 as generally shown in FIGS. 24E and 24F. As shown in FIG. 24G, the panel 168 is folded over panel 170 to configure the funnel as generally shown in FIG. 23D. As shown in FIG. 24H, the folded funnel may be compressed. Subsequently, multiple funnels may be stacked one on top of the other as shown in FIG. 23E and fastened together, for example, by way of a staple as shown in FIGS. 23F and 24I. Obviously, many modification and variations of the present invention are possible in light of the above teachings. For example, thus, it is to be understood that, within the scope of the appended claims, the invention may be practiced otherwise than as specifically described above.

The invention claimed is:

1. A collapsible funnel comprising:

a funnel blank formed from a flat piece of stock formed with a plurality of funnel panels and a glue strip disposed on one end defining an end funnel panel on an opposing end, said plurality of funnel panels forming a funnel when said end panel is joined together with said glue strip defining a fluid inlet opening and a fluid outlet opening; and at least two header cards releasably attached to at least two of said plurality of funnel panels, wherein said at least two header cards are attached to said at least two funnel panels by way of one or more perforations, said blank being formed with at least one fold line defining said at least two funnel panels, said at least two header cards disposed adjacent said fold line so that said at least two funnel panels and said at least two header cards are folded with respect to said fold line in a collapsed position and said header cards are attached together, said funnel remaining in a collapsed position until said header cards are removed or unattached relative to said fold line.

2. A collapsible funnel, comprising:

a funnel blank formed froxn a piece of flat stock defining a plurality of panels defined by fold lines, said funnel blank configured to form a collapsible funnel having a collapsed configuration and expanded configuration defining a fluid inlet end and a fluid outlet end in said expanded configuration; and a screen adapted to filter fluids received in said fluid inlet end, wherein said funnel includes at least one header card, releasably attached to one of said plural of panels and said screen is formed in said header card and adapted to be removed and inserted in said funnel.

3. A collapsible funnel comprising:

a funnel blank formed from a piece of flat stock defining a plurality of panels defined by fold lines, said funnel blank configured to form a collapsible funnel having a collapsed configuration and expanded configuration defining a fluid inlet end and a fluid outlet end in said expanded configuration; and a screen adapted to filter fluids received in said fluid inlet end, wherein said screen is affixed to said funnel with a staple.

* * * * *